United States Patent [19]

Ratterman

[11] 4,338,750

[45] Jul. 13, 1982

[54] METHOD FOR APPLYING ORGANOPOLYSILOXANE FLUIDS TO GRINDING WHEELS CONTAINING CUBIC BORON NITRIDE ABRASIVES

[75] Inventor: Ernest Ratterman, Worthington, Ohio

[73] Assignee: General Electric Company, Waterford, N.Y.

[21] Appl. No.: 201,652

[22] Filed: Oct. 28, 1980

[51] Int. Cl.[3] ..... B24B 1/00

[52] U.S. Cl. ..... 51/281 R; 51/293; 51/322; 106/287.13; 252/28

[58] Field of Search ..... 51/281, 293, 295, 322; 106/287.13; 252/28, 42.1

[56] References Cited

U.S. PATENT DOCUMENTS

| | | | |
|---|---|---|---|
| 2,823,218 | 2/1958 | Speier et al. | 252/49.6 |
| 3,159,601 | 12/1964 | Ashby | 528/15 |
| 3,159,662 | 12/1964 | Ashby | 528/15 |
| 3,220,972 | 11/1965 | Lamoreaux | 528/15 |
| 3,313,773 | 4/1967 | Lamoreaux | 528/15 |
| 3,528,789 | 9/1970 | Mathewson | 51/295 |
| 3,537,997 | 11/1970 | Wright | 252/42.1 |

*Primary Examiner*—Donald E. Czaja
*Assistant Examiner*—W. Thompson
*Attorney, Agent, or Firm*—M. J. Doyle

[57] ABSTRACT

A method for improving the overall performance of grinding wheels containing cubic buron nitride abrasives through the application of an organopolysiloxane fluid to the point of contact between the grinding wheel and a workpiece being subjected to the action of such grinding wheel. The organopolysiloxane fluid is non-toxic, and non-flammable and functions as a lubricant and coolant in the grinding process.

5 Claims, No Drawings

METHOD FOR APPLYING ORGANOPOLYSILOXANE FLUIDS TO GRINDING WHEELS CONTAINING CUBIC BORON NITRIDE ABRASIVES

This invention relates to a new and improved method for enhancing the overall performance of grinding wheels made with and containing cubic boron nitride abrasives.

BACKGROUND OF THE INVENTION

Cubic boron nitride is an abrasive designed for grinding, honing, lapping and polishing various substrates. It is bonded and formed into grinding wheels and other abrasive devices and surfaces of varying shapes, sizes and forms by means of a metal bond, an organic resin bond or by a vitreous bond. The abrasive is used most often in metalworking industries such as the automotive, bearing, cutting tool manufacturing, steel, fluid power, and gas turbine industries.

In any abrasive system friction is generated as a result of chip formation and sliding contact which, in the case of grinding, occurs at the abrasive crystal-workpiece interface, that is, at the point of contact between the abrasive substance and the substrate (workpiece) being ground, honed, lapped, polished or otherwise subjected to the action of the abrasive substance.

During such operations heat can cause premature bond failure, thermal stress failure of the abrasive and undue workpiece damage. It is well known that applying a lubricous and cooling fluid to the grinding wheel-workpiece interface during grinding operations can overcome these disadvantages.

For maximum cost effectiveness and grinding wheel life, grinding wheels containing cubic boron nitride abrasives require an adequate flow of properly selected fluids applied directly to the wheel-workpiece interface. Up to the present, water soluble oils, petroleum based oils, synthetic and semi-synthetic oils have been used as fluids in the operation of grinding wheels containing cubic boron nitride abrasives. Light duty soluble oils give satisfactory results. Even better results can be achieved through the use of heavy duty synthetic oils which contain extreme pressure (EP) additives. Such oils are widely applied to grinding wheels containing cubic boron nitride abrasives at a concentration of 1:20. Optimum results, however, are achieved with chlorosulfonated petroleum oils.

While optimum results can be achieved through the use of chlorosulfonated petroleum oils and petroleum based oils in general, there are certain disadvantages in their application as fluids for grinding wheels containing cubic boron nitride abrasives. One of the disadvantages in using the petroleum based oils is their flammability at the temperatures under which they operate. Typical flash point values for such oils will be between 280° F. and 340° F. Such oils have been known to ignite after being applied to the abrasive-workpiece interface. Another disadvantage in the use of petroleum based oils as fluids in the grinding process is the formation of toxic products in suspended mist form which result from the heating and breakdown of such petroleum oils during use. As a result of this there can be inherent health and safety hazards for individuals whose employment entails the operation of the above grinding wheels in conjunction with petroleum based fluids.

Accordingly, it is the primary object of this invention to overcome the foregoing disadvantages of the prior art fluids used to reduce frictional heat generated at the abrasive crystal-workpiece interface.

Another object of this invention is to provide a method which overcomes the safety and environmental hazards encountered in the use of petroleum based fluids in the operation of grinding wheels containing cubic boron nitride abrasives.

Another object of this invention is to provide a method which provides a grinding wheel life substantially the same as the grinding wheel life provided by methods employing prior art petroleum or synthetic based fluids while overcoming the disadvantages in the use of the petroleum based fluids.

SUMMARY OF THE INVENTION

These and other objects are achieved by using organopolysiloxane fluids in the grinding of high speed steels and other difficult to grind metals with a cubic boron nitride abrasive. In the specific case of a grinding wheel containing cubic boron nitride abrasives, when the organopolysiloxane fluids of this invention are supplied to the working surface of such abrasive during a grinding operation, an increase in grinding efficiency is achieved on certain workpieces beyond that which would normally be expected. The organopolysiloxane fluids show excellent stability when exposed to high temperatures and have a flash point in excess of 500° F. Comprehensive tests on laboratory animals have demonstrated that organopolysiloxane fluids are very low in toxicity.

In accordance with the present invention the life of a grinding wheel containing cubic boron nitride abrasives is enhanced by the application of organopolysiloxane fluids to the working surface of the grinding wheel while the grinding wheel is in operation. The organopolysiloxane fluids act as a cooling and lubricating medium to prevent the build-up of excessive heat which is generated as a result of friction between the surface of the grinding wheel and the surface of a workpiece. It has also been discovered that the organopolysiloxane fluids tend to protect the surface of the workpiece and the cubic boron nitride abrasive from oxidation by surrounding the abrasive crystal-workpiece interface with an inert material. The use of the organopolysiloxane fluids in the above grinding process with the cubic boron nitride abrasive also obviates any problems of toxicity and flammability which are inherent when prior art petroleum based fluids are used in grinding processes.

DETAILED DESCRIPTION OF THE INVENTION

The fluid organopolysiloxanes employed in the practice of the present invention are known in the art. The organopolysiloxane fluids may be characterized as organopolysiloxane fluids in which all of the valences of silicon other than those satisfied by oxygen atoms are satisfied by monovalent organic radicals attached to silicon through a silicon carbon linkage. This type of organopolysiloxane can be characterized as having the average formula:

$$R_nSiO_{4-n/2} \quad (1)$$

where R represents alkyl radicals having from one to 22 carbon atoms, cycloalkyl radicals having from 5 to 7 carbon atoms in the ring, mononuclear and binuclear aryl radicals, mononuclear aryl lower alkyl radicals, lower alkenyl radicals having from 2 to 8 carbon atoms, and halogenated derivatives of the above radicals, and n has a value of from 2.002 to 3.0.

It should be understood that the viscosity of the organopolysiloxane fluid within the scope of formula (1) will vary with the molecular weight of the fluid and with the nature of the silicon-bonded organic groups in the fluid. In the practice of the present invention, the fluid has a viscosity of from about 20 centistokes to about 200 centistokes when measured at 25° C. In the preferred embodiment, the organopolysiloxane fluid has a viscosity of about 50 centistokes at 25° C.

It should be understood that the organopolysiloxane fluids of formula (1) can include siloxane units of varied types and formulations such as triorganosiloxane units and diorganosiloxane units alone or in combination with monoorganosiloxane units. The only requirement is that the ratio of the various siloxane units employed be selected so that the average composition of the copolymeric fluid is within the scope of formula (1).

The above-identified organopolysiloxane fluid is directly applied to the cubic boron nitride abrasive-workpiece interface in the same manner generally used for the application of prior art fluids. Three of the well-known methods of applying grinding fluids include the flood system, the through-the-wheel system, and the mist cooling system. The flood system is probably the most widely used means of applying fluids for metal grinding operations. The fluid is pumped through an appropriately designed nozzle to flood the point of contact between the abrasive wheel and the workpiece. The used fluid is collected and recirculated through the system which consists of a reservoir, pump, filter and a control valve to regulate the flow of fluid.

Through-the-wheel fluid distribution also applies grinding fluid to the point of contact between the abrasive wheel and the workpiece. Fluid is pumped through two tubes and slowly discharged into a recess on the side of each wheel flange. Centrifugal force carries the fluid from these recesses through a series of holes to the wheel center and then through the porous wheel to its periphery. The system incorporates a reservoir, pump, filter and control valves.

The mist cooling system employs the atomizer principle. Compressed air passing through a T-connection syphons a small amount of fluid from a reservoir and discharges it against the point of grinding contact in the form of mist. A cooling action is created by the passage of compressed air over the wheel as well as some degree of lubrication and cooling of the wheel and workpiece by normal action of the fluid so applied.

In a preferred embodiment of the invention, a methylalkylpolysiloxane, possessing a viscosity of about 50 centistokes at 25° C., is employed as a fluid in the grinding of a metal workpiece with a grinding wheel containing cubic boron nitride abrasives. This type of organopolysiloxane can be characterized as having the average unit formula:

$$(CH_3)_n(R)_m[R'(CH_2)_3]_p(R'')_qSiO_{4-n-m-p-q/2} \quad (2)$$

wherein the sum of (m+n+p+q) has a value of from 2.002 to 3:0; n has a value of from 0.50 to 1.95; m has a value of from 0.50 to 1.00; p has a value of from 0.005 to 0.1; q has a value of from 0 to 0.25 (m+n+p); R is an alkyl radical containing from 6 to 12 carbon atoms and preferably 10; and R′ is a t-butyl-substituted hydroxyaryl radical and has the formula:

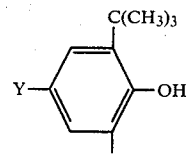

(3)

where Y is a member selected from the group consisting of hydrogen, monovalent hydrocarbon radicals, hydroxyaryl radicals, hydroxyaryl-substituted monovalent hydrocarbon radicals, hydroxyaryl ethers joined to the t-butyl-substituted hydroxyaryl radical through the ether linkage, hydroxyarylthioethers joined to the t-butyl-substituted hydroxyaryl radical through the thioether linkage and hydroxyarylmethylene ethers joined to the t-butyl-substituted hydroxyaryl radical through the methylene ether linkage; R″ is selected from the group consisting of lower alkyl radicals having one to 5 carbon atoms, cycloalkyl having from 5 to 7 carbon atoms in the ring, mononuclear and binuclear aryl radicals, mononuclear aryl lower alkyl radicals, and halogenated derivatives of the above radicals.

It should be understood that the methylalkylpolysiloxane fluids of Formula (2) can include siloxane units of varied types and formulation, such as trimethylsiloxane units and methylalkylsiloxane units alone or in combination with units such as monomethylsiloxane units, monoalkylsiloxane units, dialkylsiloxane units, trialkylsiloxane units, and the like. The only requirement is that the ratio of the various siloxane units employed be selected so that the average composition of the copolymeric fluid is within the scope of Formula (2).

The preparation of the polysiloxanes within the scope of Formula (2) involves an SiH-solefin addition reaction as described in U.S. Pat. No. 3,537,997. This reaction involves the addition of an alpha-olefin having from 6 to 12 carbon atoms, and optionally one of the allylated R′ radicals, having the formula:

$$R'CH_2CH{=}CH_2$$

where R′ is previously described, to a methylhydrogenpolysiloxane. For example, the preparation of trimethylsilyl chainstopped methyl higher alkyl polysiloxanes of Formula (2) involves the reaction between a methylhydrogenpolysiloxane having the formula:

$$(CH_3)_n(H)_{m+p}(R'')_qSiO_{4-m-n-p-q/2} \quad (4)$$

where n, m, p, q and R″ are as above-defined, and an alpha-olefin. The reaction of the alpha-olefin and the polysiloxane of Formula (4) can take place in the presence of one of the elemental platinum or platinum compound catalysts. The platinum compound catalysts can be selected from that group of platinum compound catalysts which are operative to catalyze the addition of silicon-hydrogen bonds across olefinic bonds.

Among the many useful catalysts for this addition reaction are chloroplatinic acid as described in U.S. Pat. No. 2,823,218 of Speier et al., the reaction product of chloroplatinic acid with either an alcohol, an ether or an aldehyde as described in U.S. Pat. No. 3,220,972 of Lamoreaux, trimethylplatinum iodide and hexamethyldiplatinum as described in U.S. Pat. No. 3,313,773 of Lamoreaux, the platinum olefin complex catalysts as described in U.S. Pat. No. 3,159,601 of Ashby and the platinum cyclopropane complex catalyst as described in U.S. Pat. No. 3,159,662 of Ashby.

The SiH-olefin reaction may be run at room temperature or at temperatures up to 200° C., depending upon catalyst concentration. The catalyst concentration can vary from $10^{-7}$ to $10^{-3}$ and preferably $10^{-5}$ to $10^{-4}$ moles of platinum as metal per mole of olefin containing molecules present. Generally, the methylhydrogenpolysiloxane is mixed with a portion of the alpha-olefin, all of the catalyst is added, and then the remaining alpha-olefin is added at a rate sufficient to maintain the reaction temperature in the neighborhood of from about 50° to 120° C. and, at the end of the addition of the alpha-olefin, the reaction is completed.

The addition reaction is effected by adding to the methylhydrogenpolysiloxane a platinum catalyst of one of the types previously described and then slowly adding one of the allylated materials previously described to maintain the reaction mixture at the desired reaction temperature which is usually of the order of 50° to 120° C. The amount of the allylated material added to the reaction mixture is the amount which it is desired to react with the SiH-containing polysiloxane. The allylated aromatic compound is added in the ratio of from 0 to 0.5 molecule for every silicon-bonded hydrogen atom of the methylhydrogenpolysiloxane. This results in the conversion of each siloxane unit reacted, from a methylhydrogensiloxane unit to a siloxane unit containing one silicon-bonded methyl radical and one silicon-bonded t-butyl-substituted hydroxyarylpropyl radical. The appropriate amount of alpha-olefin is then added and reacted via the aforedescribed SiH-olefin addition reaction.

The organopolysiloxane fluids employed in the practice of the present invention can also contain extreme pressure additives to further enhance the performance capability of such fluids as applied to grinding wheels containing cubic boron nitride abrasives. The extreme pressure additives which can be employed in the practice of the invention are well known in the art and include chlorides, sulfides and phosphites such as trichloroethylphosphite and nonylalkylpolysulfide. The extreme pressure additives are employed in amounts usually no greater than about one percent, the exact percentage depending on the type of organopolysiloxane fluid and the extreme pressure additive used.

The following examples illustrate the unique and unexpected effect the organopolysiloxane fluids of this invention have on the performance of grinding wheels containing cubic boron nitride abrasives but not upon diamond and aluminum oxide grinding wheels. Grinding efficiency can be determined and expressed in terms of the grinding ratio, i.e., the ratio of the volume of workpiece removed to the volume of grinding wheel wear. The higher the ratio, the greater the efficiency.

EXAMPLE 1

Three different types of fluids were used in the conventional grinding of three different types of steel using a grinding wheel containing cubic boron nitride abrasives. Except for the type of fluid used and the different types of grinding wheels used for comparative purposes, all test conditions were the same. One of the fluids was a methylalkylpolysiloxane, possessing a viscosity of 50 centistokes, manufactured and sold by the General Electric Company under the trademark SF-1147. The second fluid used in comparing grinding wheel efficiency was a light duty soluble oil manufactured and sold by the Humble Oil Company under the trademark Cutwell-30. This soluble oil was used at a dilution of 50:1. The other fluid used in comparing grinding wheel efficiency was a chlorosulfonated heavy duty petroleum based oil manufactured and sold by the Sinclair Oil Company under the designation Ordnance 912.

The three different types of steel subjected to the grinding process were M-2 steel, 52,100 steel and 410 stainless steel. All of these steels have been appropriately heat treated to a minimum Rockwell Hardness number C60.

The steel designated 52,100 is classified as a bearing steel and is used fairly extensively as the inner and outer bearing races for normal duty ball and roller bearings. It contains 0.95–1.1% carbon, 0.20–0.35% Si, 0.25–0.45% manganese and 1.3–1.6% chromium. 410 stainless steel is utilized extensively as a component part in various types of corrosion-resistant pieces of equipment such as pumps, electronic component type parts and other pieces where corrosion-resistance is required. It contains 0.15% carbon and 11.5–13.5% chromium. The steel designated M-2 is a general purpose high speed steel used for cutting tools such as end mills, drills and reamers. It is composed of 0.85% carbon 4.00% chromium, 2.00% vanadium, 5.00% molybdenum and 6.00% tungsten.

The cubic boron nitride grinding wheel employed contained BORAZON® CBN-type II manufactured by the General Electric Company. The cubic boron nitride grinding wheel is bonded with a phenolic resin and contains 25 volume percent of cubic boron nitride crystals having a size of about 80/100 U.S. mesh. The fluids were applied to the abrasive-workpiece interface by the flooding system described above. For all tests, the wheel speed was 5500 SFPM; the table speed was 50 FPM; the downfeed was 0.001 in.; and the crossfeed was 0.050 in.

The test results, as illustrated in Table 1 below, reveal that in the case of the 52,100 steel the methylalkylpolysiloxane fluid had the effect of increasing the grinding performance of the grinding wheel containing cubic boron nitride abrasives by a factor of 5 over the soluble oil while the chlorosulfonated petroleum based oil increased the performance of the grinding wheel by a factor of 13 over the soluble oil. In the case of the 410 stainless steel, the methylalkylpolysiloxane fluid increased the grinding performance by a factor of almost 12 over the soluble oil used, while the chlorosulfonated petroleum based oil improved the grinding performance by a factor of 24. In the case of the M-2 steel, grinding performance was approximately cut in half when the methylalkylpolysiloxane fluid was used as a fluid. At the present there is no explanation for this result.

Although use of the chlorosulfonated oil obtains the highest grinding ratios, it is a highly flammable fluid and forms toxic products when in use. During the course of these experiments it was necessary to provide an exhaust hood to draw off the fumes constantly generated by the grinding temperatures encountered. This hood was necessary in order to provide adequate protection for the personnel carrying out these tests. When grinding with the organopolysiloxane fluids there were no mist or vapors generated which would require exhaust and only a very faint odor is noticeable during its use.

TABLE 1

GRINDING RATIOS FOR VARIOUS FLUIDS USED WITH GRINDING WHEELS CONTAINING CUBIC BORON NITRIDE ABRASIVES UPON VARIOUS METALS

| Fluid | Type of Steel | Grinding Ratio |
|---|---|---|
| Lt. Soluble Oil 50:1 | 52,100 | 500 |
| Chlorosulfonated Oil | 52,100 | 5500 |
| Methylalkylpolysiloxane Fluid | 52,100 | 2200 |
| Lt. Soluble Oil 50:1 | 410 SS | 125 |
| Chlorosulfonated Oil | 410 SS | 2400 |
| Methylalkylpolysiloxane Fluid | 410 SS | 1250 |
| Lt. Soluble Oil 50:1 | M-2 | 1000 |
| Methylalkylpolysiloxane | M-2 | 400 |

EXAMPLE 2

In further tests two different types of fluids were used in the conventional grinding of three different types of steels using a cubic boron nitride wheel containing a 25 volume percent of 100/120 U.S. mesh BORAZON® CBN Type II. In all other respects this wheel is similar to the above-described wheel.

In addition to the M-2 and 52,100 described above, a sample of 440 stainless steel was used. This hardenable stainless steel is similar in application and chemistry to the 410 stainless steel described above. It contains 0.75–0.95% carbon and 16–18% chromium. In addition to the SF-1147 fluid, a heavy duty synthetic soluble oil identified as Adcool-3 was utilized. This is a synthetic oil manufactured by Ashland Chemical Company. It contains extreme pressure (EP) additives and was used at a dilution of 20:1. This particular heavy duty synthetic oil has been selected because it provides optimized performance for grinding wheels containing cubic boron nitride abrasives from among several commercial water soluble fluids.

For all tests the wheel speed was 5000 SFPM; the table speed was 50 FPM; the downfeed was 0.002 in.; and the crossfeed was 0.050 in. In addition to the usual measurements of wheel wear and workpiece material removed, accurate measurements of grinding energy were made during all tests. These measurements are analyzed and presented in the form of watt-hours of energy required per cubic centimeter of workpiece material removed. In general, the grinding ratio results shown in Table 2 are less than those obtained for similar workpieces in Example 1. The two exceptions are the grinding of 52,100 and 440 stainless steel using heavy duty synthetic oil. Increasing downfeed to 0.002 in. in this example doubles the rate of material removal which is normally expected to decrease the grinding ratio. It is known that the heavy duty synthetic oil used in this example is more effective as a grinding fluid for grinding wheels containing cubic boron nitride abrasives than the soluble oil used in Example 1 above.

TABLE 2

GRINDING RATIOS AND SPECIFIC ENERGY FOR VARIOUS FLUIDS USED WITH GRINDING WHEELS CONTAINING CUBIC BORON NITRIDE ABRASIVES UPON VARIOUS METALS

| Fluid | Type of Steel | Grinding Ratio | Specific Energy Wh/cm$^3$ |
|---|---|---|---|
| Methylalkylpolysiloxane Fluid | M-2 | 185 | 7.9 |
| HD Soluble Oil 20:1 | M-2 | 319 | 12.6 |
| Methylalkylpolysiloxane | 52100 | 325 | 1.0 |

TABLE 2-continued

GRINDING RATIOS AND SPECIFIC ENERGY FOR VARIOUS FLUIDS USED WITH GRINDING WHEELS CONTAINING CUBIC BORON NITRIDE ABRASIVES UPON VARIOUS METALS

| Fluid | Type of Steel | Grinding Ratio | Specific Energy Wh/cm$^3$ |
|---|---|---|---|
| Fluid | | | |
| HD Soluble Oil 20:1 | 52100 | 1475 | 3.3 |
| Methylalkylpolysiloxane Fluid | 440SS | 795 | 4.7 |
| HD Soluble Oil 20:1 | 440SS | 305 | 9.7 |

These results reveal clearly, however, that the use of a methylalkylpolysiloxane fluid very significantly reduces the grinding energy required. If the energy required to grind with the heavy duty synthetic oil is arbitrarily assigned a value of 100% on each of the three workpieces the reduction in energy required when using the SF-1147 is as follows:

TABLE 3

PERCENT REDUCTION IN SPECIFIC GRINDING ENERGY BY USING METHYLALKYLPOLYSILOXANE FLUID IN GRINDING VARIOUS TYPES OF STEEL

| Type of Steel | Percent Reduction in Energy |
|---|---|
| M-2 | 38% |
| 52100 | 70% |
| 440SS | 52% |

In other experiments using grinding wheels described above and a light soluble oil diluted 50:1, it has been shown that a 100% petroleum based fluid (Ordnance 912) will also reduce required grinding energy. Some specific examples on similar workpieces are as follows:

TABLE 4

PERCENT REDUCTION IN SPECIFIC GRINDING ENERGY BY USING STRAIGHT CHLOROSULFONATED GRINDING OIL IN THE GRINDING OF VARIOUS TYPES OF STEEL

| Type of Steel | Percent Reduction in Energy |
|---|---|
| M-2 | 7% |
| M-42 | 14% |
| 52100 | 37% |
| 410SS | 17% |

These results show that a methylalkylpolysiloxane fluid effects as great or greater a reduction in grinding energy as do 100% petroleum based fluids. This unexpected reduction in grinding energy significantly enhances the ease of chip formation, reduces frictional energy and minimizes the potential for workpiece damage.

EXAMPLE 3

Two different types of fluids were employed in the grinding of two different types of steel using an aluminum oxide abrasive. The methylalkylpolysiloxane fluid and the light soluble oil, as identified in Example 1 were used. The two steels subjected to the aluminum oxide abrasive were 52,100 steel and M-2 steel, which have previously been identified. The grinding wheel speed was 5500 SFPM; the table speed was 50 FPM; the downfeed was 0.001 in.; and the crossfeed was 0.050 in.

in all tests. The fluids were applied to the abrasive-workpiece interface through the flooding system.

The test results, as illustrated in Table 5 below, disclose that the methylalkylpolysiloxane fluid had the effect of increasing the grinding performance of the aluminum oxide abrasive with respect to 52,100 steel by a factor of 3, and with respect to M-2 steel by a factor of 2. These increases in performance when compared with the increases in performance experienced when the grinding wheel containing cubic boron nitride abrasives was employed are significantly less and are probably within the range of improvements which could be effected through the use of other soluble oil fluids. As can be seen from the above, the organopolysiloxane fluids discriminate in their effectiveness as coolants in grinding processes depending on the type of abrasive used.

TABLE 5

GRINDING RATIOS FOR VARIOUS FLUIDS USED WITH ALUMINUM OXIDE GRINDING WHEELS UPON VARIOUS METALS

| Fluid | Type of Steel | Grinding Ratio |
|---|---|---|
| Lt. Soluble Oil 50:1 | 52,100 | 35 |
| Methylalkylpolysiloxane Fluid | 52,100 | 70 |
| Lt. Soluble Oil 50:1 | M-2 | 5 |
| Methylalkylpolysiloxane Fluid | M-2 | 14 |

EXAMPLE 4

Two different types of fluids were used in the grinding of M-2 steel using a grinding wheel containing a synthetic diamond abrasive. The methylalkylpolysiloxane fluid and the light soluble oil, as identified in Example 1 were used. M-2 steel has been previously identified. Wheel speed, table speed, downfeed and crossfeed are the same as those set forth in Example 1.

The grinding wheel employed contained a diamond abrasive manufactured and sold by the General Electric Company under the trademark RVG-W. The grinding wheel is resinoid bonded and contains 25 volume percent of manufactured friable diamond crystals having a size of 100/120 U.S. mesh. The fluids were applied to the abrasive-workpiece interface through the flooding system.

The test results, as illustrated in Table 6 below, disclose that the methylalkylpolysiloxane fluid had the effect of decreasing the grinding performance of the diamond abrasive with respect to M-2 steel. This decrease was much greater in magnitude than that which occurred when the cubic boron nitride abrasive was used, again pointing out the fact that the organopolysiloxane fluids discriminate in their effectiveness in grinding processes depending on the type of abrasive used.

TABLE 6

GRINDING RATIOS FOR VARIOUS FLUIDS USED WITH GRINDING WHEELS CONTAINING A SYNTHETIC DIAMOND ABRASIVE UPON STEEL

| Fluid | Type of Steel | Grinding Ratio |
|---|---|---|
| Lt. Soluble Oil 50:1 | M-2 | 85 |
| Methylalkylpolysiloxane Fluid | M-2 | 26 |

While the foregoing examples have illustrated an embodiment of the invention, it should be understood that other variations and modifications falling within the scope of the appended claims are to be included therein.

What is claimed is:

1. A method of enhancing the performance of grinding wheels containing a cubic boron nitride abrasive comprising applying to the point of contact between the cubic boron nitride wheel and a workpiece, an organopolysiloxane fluid having a viscosity of about 20 centistokes to about 200 centistokes at 25° C., and an average formula:

$$R_nSiO_{4-n/2}$$

where R represents alkyl radicals having from one to 22 carbon atoms, cycloalkyl radicals having from 5 to 7 carbon atoms in the ring, mononuclear and binuclear aryl radicals, mononuclear aryl lower alkyl radicals, lower alkenyl radicals having from 2 to 8 carbon atoms and halogenated derivatives of the above radicals and n has a value of from 2.002 to 3.0.

2. A method according to claim 1, wherein the organopolysiloxane fluid is a methylalkylpolysiloxane fluid having the average unit formula:

$$(CH_3)_n(R)_m[R'(CH_2)_3]_p(R'')_qSiO_{4-n-m-p-q/2}$$

wherein the sum of (m+n+p+q) has a value of from 2.002 to 3.0; n has a value of from 0.50 to 1.95; m has a value of from 0.50 to 1.00; p has a value of from 0.005 to 0.1; q has a value of from 0 to 0.25 (m+n+p); R is an alkyl radical containing from 6 to 12 carbon atoms; R′ is a t-butyl-substituted hindered hydroxyaryl radical; and R″ is selected from the group consisting of lower alkyl radicals, cycloalkyl radicals having from 5 to 7 carbon atoms in the ring, mononuclear and binuclear aryl radicals, mononuclear aryl lower alkyl radicals, and halogenated derivatives of the above radicals.

3. A method according to claim 1, wherein the organopolysiloxane fluid is a methylalkylpolysiloxane fluid having the average unit formula:

$$(CH_3)_n(R)_m[R'(CH_2)_3]_p(R'')_qSiO_{4-n-m-p-q/2}$$

wherein the sum of (m+n+p+q) has a value of from 2.002 to 3.0; n has a value of from 0.50 to 1.95; m has a value of from 0.50 to 1.00; p has a value of from 0.005 to 0.1; q has a value of from 0 to 0.25 (m+n+p); R is an alkyl radical containing 10 carbon atoms; R′ is a t-butyl-substituted hindered hydroxyaryl radical; and R″ is selected from the group consisting of lower alkyl radicals, cycloalkyl radicals having from 5 to 7 carbon atoms in the ring, mononuclear and binuclear aryl radicals, mononuclear aryl lower alkyl radicals, and halogenated derivatives of the above radicals.

4. A method according to claim 1, wherein the organopolysiloxane fluid is a methylalkylpolysiloxane fluid possessing a viscosity of about 50 centistokes at 25° C., having the average unit formula:

$$(CH_3)_n(R)_m[R'(CH_2)_3]_p(R'')_qSiO_{4-n-m-p-q/2}$$

wherein the sum of (m+n+p+q) has a value of from 2.002 to 3.0; n has a value of from 0.50 to 1.95; m has a value of from 0.50 to 1.00; p has a value of from 0.005 to 0.1; q has a value of from 0 to 0.25 (m+n+p); R is an alkyl radical containing 10 carbon atoms; R′ is a t-butyl-substituted hindered hydroxyaryl radical; and R″ is selected from the group consisting of lower alkyl radicals, cycloalkyl radicals having from 5 to 7 carbon atoms in the ring, mononuclear and binuclear aryl radicals, mononuclear aryl lower alkyl radicals, and halogenated derivatives of the above radicals.

5. A method according to claim 1, wherein the organopolysiloxane fluid further comprises a minor amount of at least one extreme pressure additive.

* * * * *